United States Patent [19]

Mowdood et al.

[11] Patent Number: 4,780,225

[45] Date of Patent: Oct. 25, 1988

[54] LUBRICANT AND USE THEREOF FOR CURING TIRES

[75] Inventors: Syed K. Mowdood, Akron; George P. Patitsas, Kent; Walter H. Waddell, Fairlawn, all of Ohio

[73] Assignee: The Goodyear Tire & Rubber Company, Akron, Ohio

[21] Appl. No.: 179,013

[22] Filed: Apr. 8, 1988

[51] Int. Cl.[4] ..... C10M 105/76; C10M 111/02

[52] U.S. Cl. ..... 252/28; 252/49.5; 252/49.6; 106/38.22

[58] Field of Search ..... 252/21, 28, 51.5 A, 252/49.5, 49.6; 106/38.22

[56] References Cited

U.S. PATENT DOCUMENTS

| | | | |
|---|---|---|---|
| 3,532,624 | 10/1970 | Cekada, Jr. | 252/28 |
| 3,713,851 | 1/1973 | Cekada, Jr. | 252/28 |
| 4,039,143 | 8/1977 | Brown, Jr. et al. | 252/28 |
| 4,043,924 | 8/1977 | Traver | 252/28 |
| 4,066,560 | 1/1978 | Van Vleck et al. | 252/28 |
| 4,178,257 | 12/1979 | Berry et al. | 252/28 |
| 4,431,452 | 2/1984 | Comper et al. | 252/28 |
| 4,509,984 | 4/1985 | Scheiderich et al. | 252/28 |

*Primary Examiner*—Jacqueline V. Howard

*Attorney, Agent, or Firm*—Henry C. Young, Jr.

[57] ABSTRACT

A lubricant composed of a siloxane, a fatty acid lubricant, mica and at least one selected thickener and use thereof for curing tires.

11 Claims, No Drawings

LUBRICANT AND USE THEREOF FOR CURING TIRES

FIELD OF THE INVENTION

This invention relates to tire curing bladder lubricant compositions, tire inner surfaces or tire curing bladders or flexible curing molds outer surface having a coating of such lubricant composition, and a method of curing tires or semirigid or flexible polymeric products utilizing such a coated bladder.

BACKGROUND

Conventionally, pneumatic rubber vehicle tires are produced by molding and curing a green, or uncured, tire in a molding press in which the green tire is pressed outwardly against a mold surface by means of an inner, fluid expandable bladder. By this method, the green tire is shaped against the outer mold surface which defines the tire's tread pattern and configuration of sidewalls. By application of heat, the tire is cured. Generally, the bladder is expanded by internal pressure provided by a fluid such as hot gas, hot water and/or steam which also participates in the transfer of heat for curing or vulcanization purposes. The tire is then allowed to cool somewhat in the mold, sometimes aided by added cold or cooler water to the bladder. Then the mold is opened, the bladder collapsed by removal of its internal fluid pressure and the tire removed from the tire mold. Such use of the tire curing bladder is well known to those having skill in such art.

It is recognized that there is a substantial relative movement between the outer contacting surface of the bladder and the inner surface of the tire during the expansion phase of the bladder prior to fully curing the tire. Likewise, there is also a considerable relative movement between the outer contacting surface of the bladder and the inner surface of the cured tire after the tire has been molded and vulcanized during the collapse and the stripping of the bladder from the tire.

Unless adequate lubrication is provided between the bladder and the inner surface of the green tire, there is typically a tendency for the bladder to buckle resulting in a mis-shaping of the green tire in the mold and also excessive wear and roughening of the bladder surface itself. Also, the bladder surface can tend to stick to a tire's inner surface after the tire is cured and during the bladder collapsing portion of the tire curing cycle. Further, air bubbles can sometimes potentially become trapped between the bladder and tire surfaces and promote tire vulcanizing defects due to lack of adequate heat transfer.

Lubrication of the interfacial surfaces of the curing bladder and innerliner (or inner surface) of the tire can be accomplished by various methods. For example, a suitable lubricant can be applied directly to the bladder surface and/or to the tire innerliner.

Thus a lubricant can be used to pre-coat the inner surface of the green or uncured tire in order to provide lubricity between the outer bladder surface and inner tire surface during the green tire shaping and molding operation. Sometimes, such lubricant has been called a lining cement. By this method, the inner surface of the green tire, which is typically a rubber gum stock, can be simply spray-coated in a confined, ventilated, spray booth, with a lubricant which might, for example, be based upon a silicone polymer. Other additives may also conventionally be utilized in the lubricant composition, if desired, such as mica, polymeric polyols, cellulose ethers, clay such as bentonite clay and the like. Some lubricants are solvent based and some are water based. Often aqueous soap solutions are utilized. Many lubricant compositions have been taught in the art for such purpose.

Alternatively, a silicone-based lubricant can be applied to the bladder surface instead of or in combination with the application of the aforesaid lining cement.

Various silicone-based lubricant compositions have been suggested for such purposes which have sometimes been referred to as band ply lubricants. Various of the lubricants have been composed of a polyorganosiloxane mixed with various materials such as, for example, (a) polyalkylene glycol, (b) mica, (c) aluminum silicate, (d) lecithin and (e) water (U.S. Pat. No. 3,713,851); (a) mica, (b) metal silicates, (c) bentonite clay, (d) emulsifying agent and (e) lecithin (U.S. Pat. No. 3,872,038); (a) mica and (b) hydroxybutyl methyl cellulose as a thickening agent (U.S. Pat. No. 3,967,968): (a) alkylene oxide polyol, (b) mica, (c) talc, (d) bentonite clay, (e) mineral colloids, (f) suspending agent such as sorbitan ester and (g) a fatty acid such as oleic or linolenic acid (U.S. Pat. No. 4,039,143); (a) alkylene oxide polyol, (b) mica, (c) talc, (d) magnesium silicate, (e) emulsifying agent and (f) thickening agent (U.S. Pat. No. 4,043,924); (a) mica, (b) clay, (c) polyalkylene ether polyol, and (d) emulsifying agent (U.S. Pat. No. 4,066,560); and (a) mica, (b) kaolin, (c) thickener - cellulose types, (d) lecithin and (e) anionic emulsifiers (U.S. Pat. No. 4,244,742).

DISCLOSURE AND PRACTICE OF INVENTION

In accordance with this invention, a lubricant composition is provided as the product of a mixture which comprises:

(A) about 5 to about 100 parts by weight polydimethyl siloxane characterized by having a viscosity in the range of about 200,000 to about 1.2 million, more preferably about 300,000 to about one million, centipoises at 25° C.

(B) about 10 to about 700 parts by weight mica having a particle size of less than about 200, preferably an average of less than about 400, U.S. standard mesh size.

(C) at least one of the following thickening tire materials:

(1) about 5 to about 100 parts by weight kaolin clay having an average particle size of less than about 400 U.S. standard mesh size, (2) about 5 to about 100 parts by weight bentonite clay having an average particle size of less than about 400 U.S. sandard mesh size, and (3) about 5 to about 25 parts by weight of at least one of hydroxypropyl methyl cellulose, hydroxybutyl methyl cellulose and methyl cellulose.

(D) about 5 to about 40, preferably about 10to about 20, parts by weight of at least one fatty amide lubricant and having a softening point according to ASTM No. 1894-78 in the range of about 68° C. to about 86° C. preferably those selected from erucamide, oleamide, and stearamide.

The siloxane is to be water emulsifiable.

In one alternative, the siloxane can be hydroxyl terminated.

The composition for application to the bladder surface to the tire inner surface and/or bladder surface is an aqueous emulsion, or dispersion, of the compositions.

For example, the composition for such application also contains (I) about 500 to about 1500, preferably about 600 to about 900, parts by weight water which, after application to the bladder, is dried by evaporation. Certainly more water could be used, although additional dilution of the composition should be expected to reduce the efficiency of its application and increase drying time.

For such aqueous mixture, various emulsifiers are typically used, such as, for example, alkyl aryl polyethers, anionic and non-ionic surfactants. If desired, a polyalkylene glycol can be used such as, for example, polyethylene glycol.

In further accordance with this invention, (A) an expandable rubber tire-curing bladder having such a coating composition thereon (particularly after water removal) is provided; (B) the inner surface of a green tire, whether shaped or unshaped, having such a coating composition thereon (particularly after water removal) is provided; (C) the inner surface of a cured, shaped tire having such a coating composition thereon (particularly after water removal) is provided.

In practice, the rubber for the bladder or for the tire inner surface can be a butyl or butyl-type rubber (copolymer of isoprene and isobutylene). By the term butyl-type, it is intended to mean various modified basic butyl rubbers such as halogen-substituted butyl rubbers which may be, for example, chlorobutyl or bromobutyl rubber.

In still further practice of this invention, a method of preparing a pneumatic or semi-pneumatic rubber tire is provided in which a coated green tire of this invention is placed in a tire mold, an expandable bladder is positioned therein, the mold closed and bladder expanded by application of internal hot fluid pressure to force the tire outward against the mold surface to shape and cure the tire followed by opening the mold, collapsing the bladder and removing the shaped and cured tire. The bladder is generally connected to an internal part of the tire mold itself.

In more detail, for example, such a method of molding a pneumatic or semi-pneumatic tire which comprises the steps of:

(A) providing or building a green tire with elements which are to be its outer tread for ground-contacting purposes, two spaced inextensible beads, sidewalls extending radially outwardly from said beads to join said tread, supporting carcass with reinforcing elements, and an inner surface of rubber gum stock coated with the coating composition of this invention;

(B) inserting said coated green tire into a tire mold press and positioning a tire cure bladder inside of said green tire, said bladder being attached to an internal portion of said tire press;

(C) closing the tire mold and expanding said tire cure bladder by internal, heated fluid outwardly against the inner gum stock surface of said tire to press the tire outward under conditions of heat and pressure to shape and cure said tire;

(D) opening the tire mold, collapsing said bladder and removing the cured tire having a generally toroidal shape therefrom.

In a preferred embodiment, the invention is practiced by applying the coating to the inner surface of the green tire.

The term "pneumatic tire" relates to tires whch rely on an internal fluid, such as air under pressure in their tire cavity for their proper operation when mounted on a rim and the term "semi-pneumatic" tire relates to tires which contain an internal fluid, such as air, in their cavity but do not totally rely on its pressure for its proper operation when mounted on a rim.

In the practice of this invention, the aqueous emulsion or dispersion of the lubricant composition can conveniently be provided by the method which comprises (A) pouring the water into a mixing vessel and adding the polydimethyl siloxane with continuous agitation of about 600 rpms; (B) preferably premix (dry mix) part of the mica or clay with the hydroxypropyl methyl cellulose and then add it to the fluid; (C) add the other ingredients with continuous agitation in the order shown in Table I of Example I herein. This technique coats and separates the hydroxypropyl methyl cellulose particles from each other and prevents agglomeration or lump formation.

It is surely appreciated that various relatively well known defoaming agents, various stabilizers and various biocides can be used in the practice of this invention which are generally well known to those having skill in the pertaining art.

The aqueous emulsion or dispersion is simply coated, such as by spray coating, onto the tire inner surface, or bladder's outer surface, and dried by evaporation at a temperature, for example, in the range of about 10° C. to about 110° C. It is preferred that the bladder is from about 80 to about 150 percent of its tire curing expanded position or condition for this coating purpose (as opposed to being deflated or collapsed), although it is not considered necessary and bladders have been successfully coated in a somewhat deflated condition. Green tires are coated in their natural form, whether shaped or unshaped.

An optional defoamer can be used for the aqueous mixture such as a dimethyl-polysiloxane emulsion in water which is beneficial because it prevents or inhibits foam formation during mixing.

The practice of this invention is further illustrated by reference to the following example which is intended to be representative rather than restrictive of the scope of the invention. Unless otherwise indicated, all parts and percentages are by weight.

EXAMPLE 1

A lubricant composition was prepared according to the following recipe shown in Table 1.

TABLE 1

| Material | Parts (Rounded to the nearest tenth) |
|---|---|
| Water | 2048.0 |
| Polydimethylsiloxane[1] | 240.0 |
| Mica[2] | 1112.0 |
| Kaolin clay[3] | 80.0 |
| Bentonite clay[4] | 80.0 |
| Oleamide[5] | 32.0 |
| Alkyl aryl polyether emulsion[6] | 10.0 |
| Fluorosurfactant[7] | 0.8 |
| Hydroxypropyl methyl cellulose[8] | 12.0 |
| Tacfoam (defoamer)[9] | 2.8 |
| Giv Gard DXN (biocide)[10] | 0.3 |

[1]A concentrated aqueous emulsion of a polydimethylsiloxane, the siloxane reportedly having a viscosity in the range of about 600,000 to about 1 million centipoises and by being hydroxyl capped as a mixture comprised of about 70 parts of the siloxane, about 10 parts emulsifier and 20 parts water.
[2]Mica obtained as 160 mesh water ground mica, a trademark of the English Mica company, reportedly having an average particle size of about 20 microns.

TABLE 1-continued

| Material | Parts (Rounded to the nearest tenth) |
|---|---|

[3]Kaolin clay obtained as Borden R clay, a trademark of the J. M. Huber Corporation, reportedly having a particle size of about 25 microns.
[4]Bentonite clay obtained as Volclay 325 mesh, a trademark of the American Colloid Company reportedly having a particle size of 20 microns.
[5]An oleamide obtained as Kemamide U-60, a trademark of the Humko Division, Witcochem Corporation, as an unsaturated fatty amide characterized by powdery nature having a particle size of about 10 microns and a melting range of 68 to 86° C.
[6]An alkyl aryl polyether emulsion obtained as Triton CF-10, a trademark of Rohm and Haas Company, characterized as a nonionic surfactant.
[7]Fluoro surfactant obtained as Zonyl FSP a trademark of the Du Pont de Nemours & Company and reportedly characterized by excellent wetting characteristics.
[8]Hydroxypropyl methyl cellulose obtained as Methocel K100LV, a trademark of the Dow Chemical Company and reportedly characterized by forming a thixotropic solution in water.
[9]Tacfoam VCPAC obtained as a non-silicone defoamer, a trademark of the Versa Chem Incorporated.
[10]Giv Gard DXN biocide obtained as an emulsifiable liquid, a trademark of the Givaudan Corporation, Clifton, New Jersey.

The aqueous emulsion dispersion was prepared according to the following procedure:

(A) water was charged into the mixing vessel and the agitator set at a moderate speed (about 600 rpm), (B) the polydimethylsiloxane paste was added and mixing continued until it was completely dissolved in the water, (C) dry blend the hydroxypropyl methyl cellulose powder with the mica or clay powders before adding it to the batch, (D) all other ingredients were added in the order shown in Table 1.

EXAMPLE II

A bias aircraft tire, 56×20-20, was fabricated and used as follows:

The inside surface of the green (uncured) tire was sprayed with the lubricant composition described in Table 1, and the coating was dried at room temperature.

The tire was placed in a tire mold press and a bladder attached to the mold was inserted inside the tire. The mold was closed and the bladder was expanded by steam at a temperature of about 190° C. to force it against the inside surface of the tire and press the green tire outwardly against the mold surface so that the tire was shaped and cured.

The mold was then opened, the bladder collapsed and the tire removed therefrom.

EXAMPLE III

Similarly a green tire is cured using a bladder coated with the composition of this invention.

EXAMPLE IV

A radial sport tire, 25.5×14.0-16, was treated as follows:

The inside halobutyl rubber surface of the green (uncured) tire was sprayed with the lubricant composition described in Example I, and the coating was dried at room temperature.

The tire was placed in a tire mold press and a bladder attached to the mold was inserted inside the tire. The mold was closed and the bladder was expanded by steam at a temperature of about 150° C. to force it against the inside surface of the tire and press the green tire outwardly against the mold surface so that the tire was shaped and cured.

The mold was then opened, the bladder collapsed and the tire removed therefrom.

It is important to appreciate that the invention utilizes a relatively small amount of siloxane material to basically get as a binder for the mica. The formulation derives a major portion of its lubricity from the mica. The binding of the mica and clay(s) by the siloxane tends to prevent or inhibit the migration of the siloxane itself into the green tire's inner surface (e.g. innerliner). It thus reduces, or inhibits, the impregnation of the tire rubber with the siloxane which is considered to be an important benefit.

The two types of clays are used to maintain a more neutral pH for less corrosive effects on preparation application equipment.

Fatty amides provide controlled lubricity during tire molding conditions.

While certain representative embodiments and details have been shown for the purpose of illustrating the invention, it will be apparent to those skilled in this art that various changes and modifications may be made therein without departing from the spirit or scope of the invention.

What is claimed is:

1. A lubricant composition which comprises:

(a) about 5 to about 100 parts by weight polydimethylsiloxane characterized by having a viscosity in the range of about 300,000 to about 1.2 million centistrokes at 25° C.;

(b) about 10 to about 700 parts by weight mica having an average particle size of less than about 200 U.S. standard mesh size;

(c) at least one of the following thickening materials (1) about 5 to about 100 parts by weight kaolin clay having an average particle size of less than 400 U.S. standard mesh size:

(2) about 5 to about 100 parts by weight bentonite clay having an average particle size of less than about 400 U.S. standard mesh size and (3) about 5 to about 25 parts by weight of at least one of hydroxypropyl methyl cellulose, hydroxybutyl methyl cellulose and methyl cellulose and (d) about 5 to about 40 parts by weight fatty amide lubricant having a softening point according to ASTM 1894-78 in the range of about 68° C. to about 86° C.

2. The composition according to claim 1 wherein said siloxane is hydroxyl capped.

3. The composition according to claim 1 wherein said fatty amide is selected from at least one of erucamide, oleamide and stearamide.

4. The composition according to claim 1 wherein mixture also contains a polyalkylene glycol.

5. The composition according to claim 4 wherein said polyalkylene glycol is comprised of a polyethylene glycol.

6. A method of preparing a tire by the steps of (a) applying an aqueous coating composition to the innerliner of a green tire and substantially drying said coating thereon wherein said coating material is the composition of claim 1;

(b) inserting said coated tire into a suitable tire mold;

(c) curing the green tire by expanding a tire cure bladder against its said coated innerliner under conditions of heat and pressure; and (d) removing said tire from said mold after collapsing said bladder.

7. The method according to claim 6 wherein said siloxane is hydroxyl capped.

8. The method according to claim 6 wherein the fatty amide in said composition is selected from at least one of erucamide, oleamide and stearamide.

9. The method according to claim 6 wherein said coating composition also contains a polyalkylene glycol.

10. A tire having an innersurface with a coating therein of a composition according to claim 1.

11. The tire of claim 10 wherein the fatty amide of the coating composition thereon is selected from at least one of erucamide, oleamide and stearamide.

* * * * *